US005340344A

United States Patent [19]

Mineo et al.

[11] Patent Number: 5,340,344

[45] Date of Patent: Aug. 23, 1994

[54] AIR INTAKE SYSTEM

[75] Inventors: Shigeharu Mineo; Kazuhiro Okuzawa, both of Hamamatsu, Japan

[73] Assignee: Sanshin Kogyo Kabushiki Kaisha, Hamamatsu, Japan

[21] Appl. No.: 48,476

[22] Filed: Apr. 16, 1993

[30] Foreign Application Priority Data

Apr. 30, 1992 [JP] Japan ..... 4-137796

[51] Int. Cl.[5] ..... B63H 21/10

[52] U.S. Cl. ..... 440/88; 114/270

[58] Field of Search ..... 114/270; 440/38, 88, 440/75–77, 900; 181/229, 264, 233, 235; 123/195 P

[56] References Cited

U.S. PATENT DOCUMENTS 4,319,657 3/1982 Nomura ..... 181/229

4,636,176 1/1987 Capilla ..... 440/12

FOREIGN PATENT DOCUMENTS 361152 6/1991 Japan .

OTHER PUBLICATIONS

90–91 Honda CBR1000F Service Manual pp. 1–27, 1989.

*Primary Examiner*—Edwin L. Swinehart

*Attorney, Agent, or Firm*—Knobbe, Martens, Olson & Bear

[57] ABSTRACT

An air intake device for a marine propulsion engine that effectively separates water from the intake air and precludes that water from being swept back into the induction system for the engine. A plenum chamber is formed as a separate part of the air intake device and is connected to the carburetor through a transition portion that extends across the upper end of the plenum chamber. The plenum chamber is displaced forwardly of the carburetor so as to not interfere with it or restrict its size.

14 Claims, 4 Drawing Sheets

AIR INTAKE SYSTEM

BACKGROUND OF THE INVENTION

This invention relates to an air intake system and more particularly to an improved induction system for a marine propulsion engine.

It is well known in the marine propulsion engines to employ an air intake device that functions to silence the intake air drawn into the engine for its operation. However, due to the fact that the engine is operating in a body of water and there will be considerable water vapor present in the inducted air, many types of induction devices for engines also include an arrangement for attempting to separate water particles from the inducted air. In one form of such system, the induction device surrounds the air inlet to the induction system and provides a volume in which water separated from the intake air may be accumulated and subsequently drained. These devices normally encircle the air inlet for the engine and thus, the water which is separated is subjected to the air flow through the inlet device and thus, the separated water can again be swept back into the air stream and delivered to the engine.

In addition to the aforenoted problems, frequently the powering internal combustion engine is used with a type of watercraft that by its very sporting nature is anticipated to capsize or become inverted. Even if the water is separated from the induction air and retained in the air inlet device, such inversion and subsequent righting can, with the prior art type of constructions, cause the separated water to flow directly into the engine air intake. This is obviously undesirable.

In addition, if the air inlet for the engine comprises a carburetor, the surrounding arrangement limits the size of the carburetor and makes the carburetor more difficult to service.

It is, therefore, a principle object of this invention to provide an improved air induction system for a marine propulsion engine.

It is a further object of this invention to provide an improved air intake device for a marine propulsion engine wherein the intake device includes means for separating water from the intake air and also ensures that the water separated will not be mixed again with the inducted air and enter the engine.

It is a further object of this invention to provide an improved water separating air intake device for a marine engine wherein the water separating and collecting chamber is disposed at a location that is spaced from the engine air inlet to not interfere with the air inlet or a carburetor which supplies a fuel/air charge to the engine.

SUMMARY OF THE INVENTION

This invention is adapted to be embodied in an air induction system for the air intake of an internal combustion engine for powering a watercraft. The air intake extends in a generally vertical direction and has an upper opening. The induction system comprises an air intake device having a plenum chamber formed of substantial volume and displaced from the air intake and which depends a substantial distance below the upper opening. An atmospheric air inlet communicates atmospheric air with the plenum chamber above the lower end thereof and a discharge communicates the plenum chamber with the upper opening.

DETAILED DESCRIPTION OF THE PREFERRED EMBODIMENT OF THE INVENTION

Figure 1:
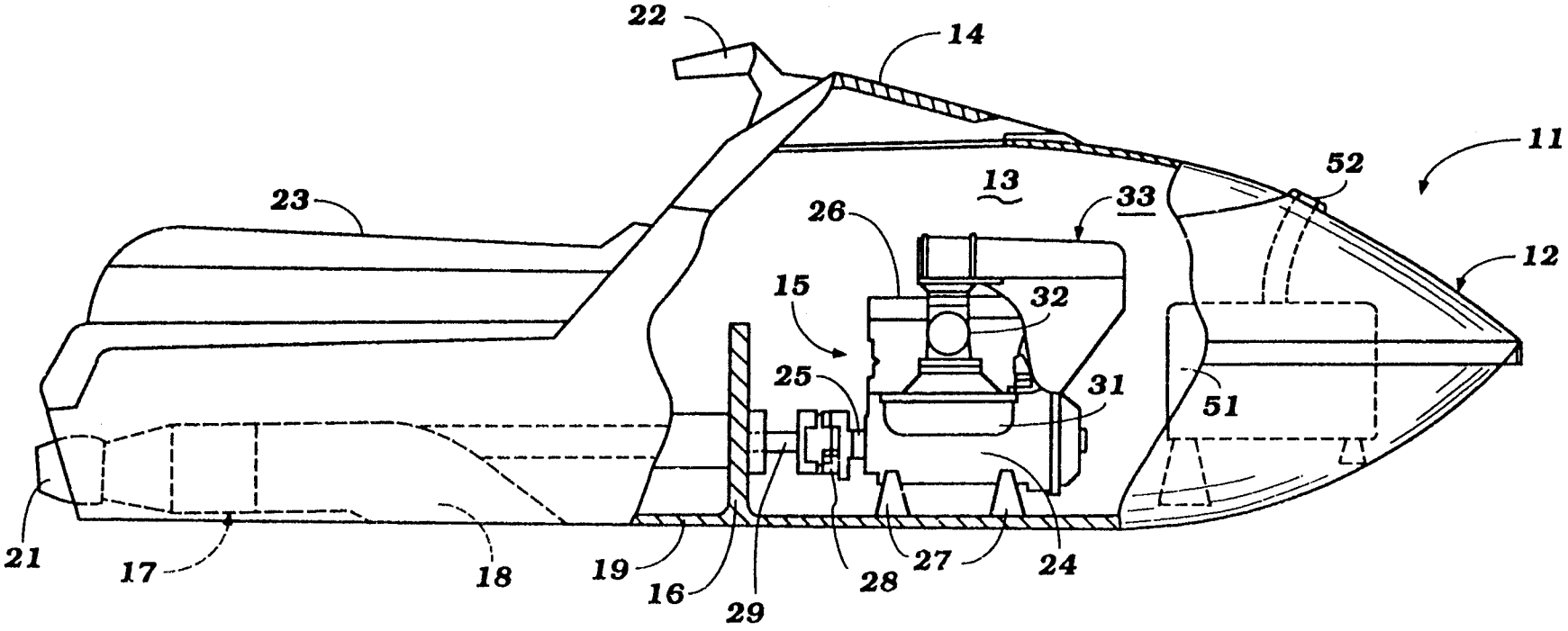
FIG. 1 is a side elevational view of a small watercraft constructed in accordance with an embodiment of the invention, with a portion broken away so as to more clearly show the construction.

Referring first in detail to FIG. 1, a small watercraft constructed in accordance with an embodiment of the invention is identified generally by the reference numeral 11. The watercraft 11 is typical of the type of watercraft in which the invention can be utilized and it should be readily apparent to those skilled in the art how the invention can be practiced with other types of watercraft than those illustrated.

The watercraft 11 is comprised of a hull, indicated generally by the reference numeral 12 which may be formed from a suitable material such as a molded fiberglass reinforced resinous plastic or the like. The forward portion of the hull 12 defines an engine compartment 13 which is accessible through a removable hatch cover 14. An internal combustion engine having an induction system constructed in accordance with an embodiment of the invention is identified generally by the reference numeral 15 and is mounted in the engine compartment 13.

A bulkhead 16 separates the engine compartment 13 from a tunnel formed at the rear of the hull 12 and in which a jet propulsion unit, indicated generally by the reference numeral 17, is positioned. As with the general configuration of the watercraft 11, although the invention is described in conjunction with a jet propelled watercraft, it should be readily apparent to those skilled in the art that the invention may be employed with watercraft powered by more conventional propulsion devices such as propellers.

Because of this, the details of the jet propulsion unit are not illustrated and, for orientation purposes only, it should be understood that the jet propulsion unit 17 has a downwardly facing water inlet opening 18 which registers with a suitable opening in a lower part 19 of the hull and through which water is drawn by the operation of the jet propulsion unit 17. This water is then discharged through a discharge nozzle upon which a steering nozzle 21 is supported for steering movement for steering of the watercraft 11 in a well known manner. A handlebar assembly 22 is provided to the rear of the hatch cover 14 and is coupled to the steering nozzle 21 in a well known manner.

A rider's seat 23 is disposed behind the steering handle 22 and is adapted to support one or more riders seated in straddle tandem fashion.

The powering internal combustion engine 15 may, as has been noted, be of any known type but in the illustrated embodiment, the engine 15 is of the two cylinder in-line crankcase compression water-cooled type. To this end, the engine 15 is provided with a cylinder block crankcase assembly 24 in which an output shaft 25 is journaled for rotation. A cylinder head assembly 26 is affixed to the cylinder block crankcase assembly 24 and encloses the internal components of the engine, which are well known in this art. The cylinder block crankcase assembly 24 is supported in the engine compartment 13 on engine mounts 27 in a well known manner.

The engine output shaft 25 is connected to an elastic coupling 28, which, in turn, transfers drive to an impeller shaft 29 that extends through the bulkhead 16 and back into the jet propulsion unit for driving it in a well known manner.

The engine 15 is provided with an air induction and charge forming system which includes, as is typical with two cycle practice, an intake manifold 31 which supplies a fuel/air charge to the crankcase chambers of the engine 15 through reed-type valve assemblies. A charge former such as a down draft carburetor 32 is mounted on the intake manifold 31 and mixes fuel with the inducted air, as is well known in this art, for delivery to the crankcase chambers. In accordance with the invention, a silenced air charge is delivered to the carburetor 32 by an air intake device, indicated generally by the reference numeral 33, and which is constructed in accordance with an embodiment of the invention. It is this air intake device 33 which embodies the invention and, for that reason, the other components of the engine may be considered to be conventional and the invention may be utilized with any type of conventional engine, including a two cylinder in-line two cycle crankcase compression engine of the type illustrated.

The air intake device 33 includes a large plenum chamber defining a volume 34 by means of a lower piece 35 and an upper cover piece 36 which are formed from suitable materials and which are connected to each other in a suitable manner, including by means of fasteners 37 which also cooperate with the carburetor 32 so as to affix an outlet portion 40 into registry with an upwardly extending air inlet opening of the carburetor 32.

The plenum chamber 34, as may be readily seen in the figures, has a substantial vertical height and depends well below the carburetor 32. This plenum chamber 34 receives atmospheric air through a generally L-shaped air inlet tube 38 which extends through a side wall of the lower portion 35 and the cover 36 and which faces inwardly and downwardly toward the cylinder block at the forward end thereof. The inlet tube 38 has a downwardly extending portion 39 that directs the inlet air downwardly into the plenum chamber 34 in an area between a pair of converging side walls 41 and 42 which have a length indicated by the dimension 43 to their lower ends. The flow of air through the inlet device 33 is shown in FIG. 6.

Figure 6:
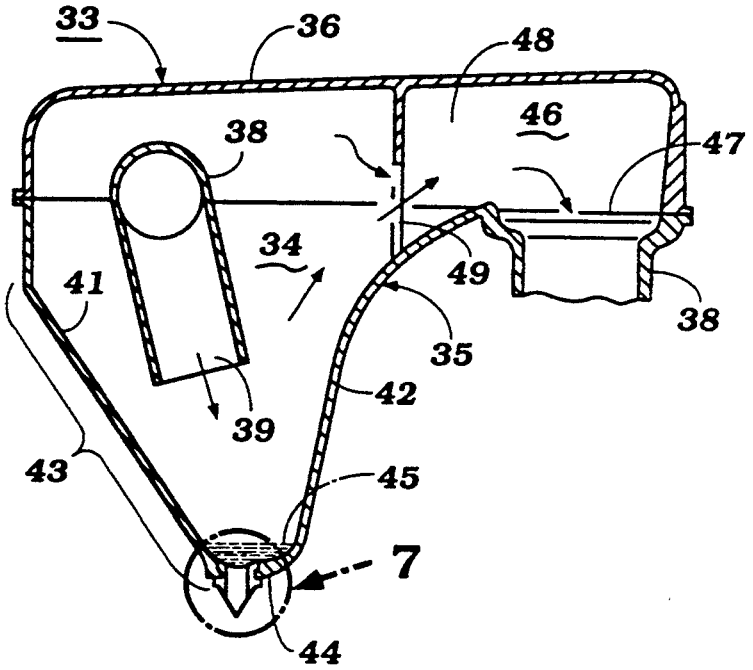
FIG. 6 is an enlarged cross-sectional view of the air inlet device taken along the line 6—6 of FIG. 2.
Figure 7:
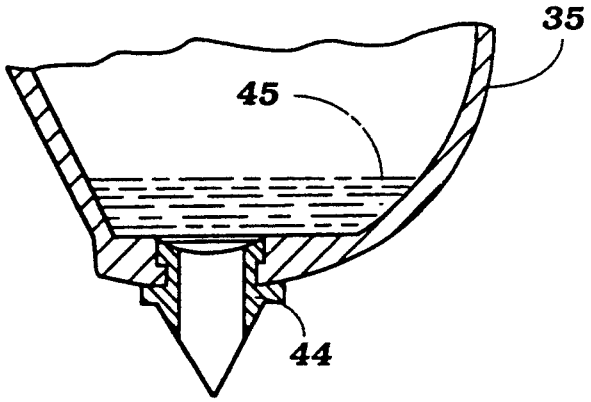
FIG. 7 is an enlargement of the area encompassed by the circle 7 in FIG. 6.

It should be noted that a well is formed at the lower end of the plenum chamber portion at the bight of the walls 41 and 42 and a drain fitting 44, which may include a resilient duck bill type of check valve (not shown) will permit any separated water, indicated by the line 45 in FIGS. 6 and 7, to be easily drained.

Rearwardly of the plenum chamber 34, the air inlet device is provided with a smaller volume portion 46 from which the air outlet portion 40 depends and which communicates with the air outlet through a horizontally disposed opening 47. A baffle wall 48 separates the air inlet device plenum chamber 34 from the outlet section 46 and defines a relatively narrow air passage 49 through which the air must flow from the plenum chamber 34 to enter the carburetor 32. This, in effect, provides a labyrinthine type of air flow which will further assist in water separation from the intake air.

It also should be noted that the plenum chamber 34 is disposed forwardly of the carburetor 32 and thus it in no way interferes with the ability to service or access the carburetor 32. In addition, the construction permits the use of a carburetor of any desired size.

Referring again to FIG. 1, fuel is supplied to the carburetor 32 from a forwardly positioned fuel tank 51 that is positioned in the engine compartment 13 forwardly of the engine 15. An external fill cap 52 permits fueling of the fuel tank 51 in a known manner.

Figure 2:
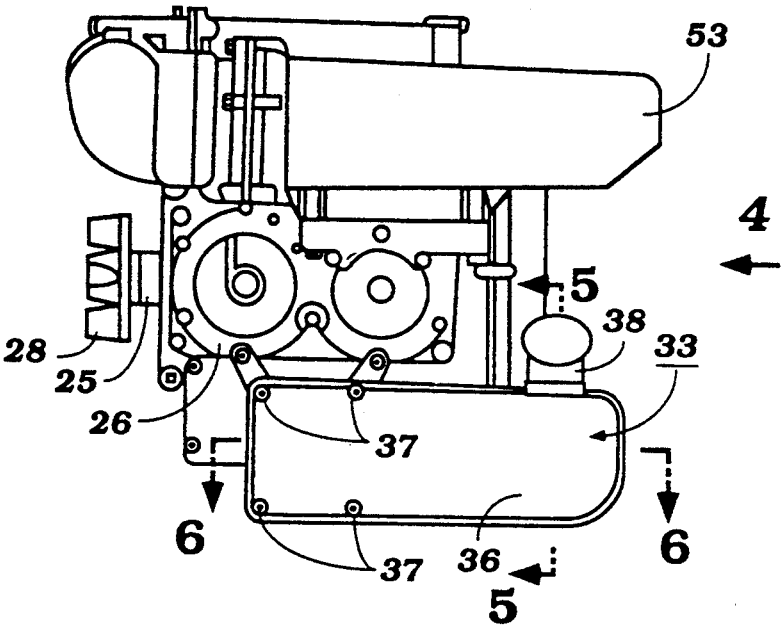
FIG. 2 is an enlarged top plan view of the powering internal combustion engine for the watercraft.
Figure 3:
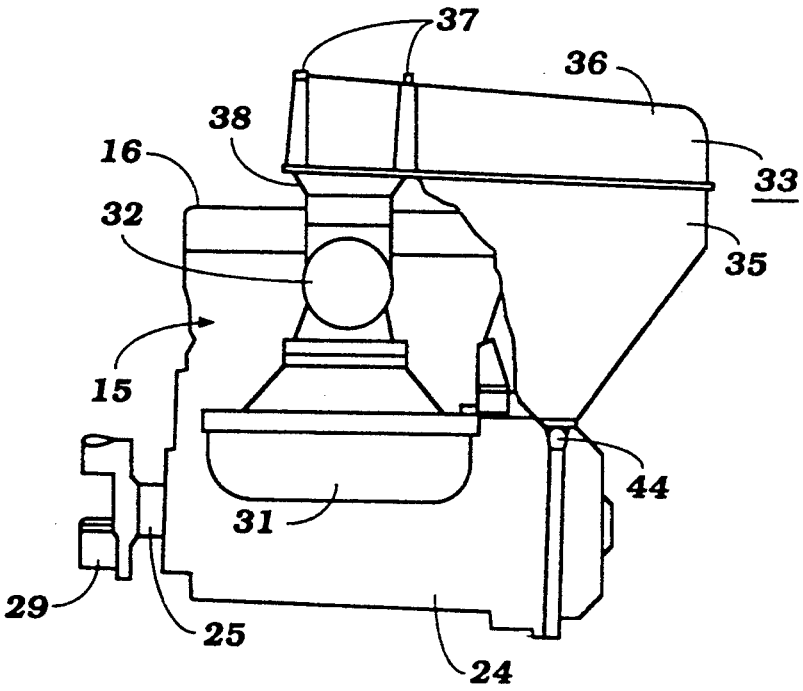
FIG. 3 is a side elevational view of the engine.
Figure 4:
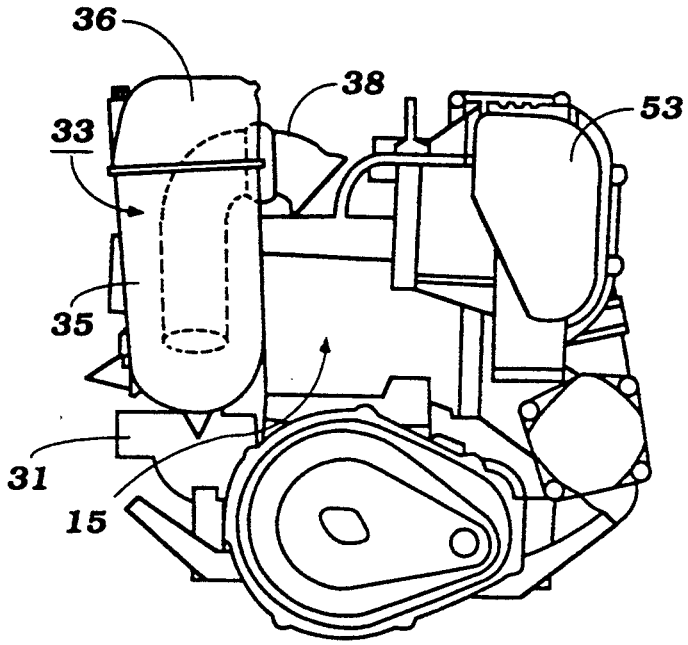
FIG. 4 is a front elevational view of the engine looking in the direction of the arrow 4 in FIG. 2.
Figure 5:
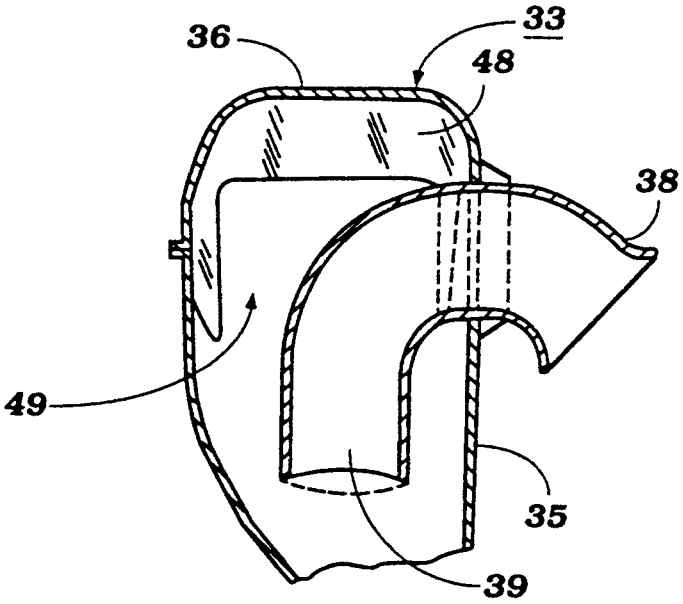
FIG. 5 is an enlarged cross-sectional view of a portion of the air inlet device and is taken along the line 5—5 of FIG. 2.

The engine is also provided with an exhaust system and this includes a water cooled exhaust manifold 53 (FIGS. 2 and 4) which is disposed on the opposite side of the engine from the air inlet device 33 and which receives exhaust gases from the engine and also coolant which has been circulated through the engine. These exhaust gases and the spent coolant is discharged back into the body of water in which the watercraft is operating in any suitable manner.

It should be readily apparent that the description and construction of the air inlet device 33 and the separation of its plenum chamber 34 from the air outlet opening 47 ensures good water removal and also reduces the likelihood that any water can be swept into the induction system once it is separated. Also, the volume is such that if the watercraft 11 should inadvertently become capsized, that the water will not flow out the outlet opening 47 and enter the carburetor 32 even once the watercraft is again righted.

Of course, the foregoing description is that of a preferred embodiment of the invention and various changes and modifications may be made without departing from the spirit and scope of the invention, as defined by the appended claims.

We claim:

1. An air induction system for the air intake of an internal combustion engine for powering a watercraft having a hull in which said engine is positioned, said air intake extending in a generally vertical direction and having an upper opening, said induction system comprising an air intake device having a plenum chamber formed of substantial volume and displaced from said air intake and depending a substantial distance below said upper opening and within said hull, an atmospheric air inlet entering said plenum chamber at the top thereof and directed to cause the atmospheric air to flow toward the lower end of said plenum chamber, and a discharge communicating said plenum chamber with said upper opening.

2. An air induction system as set forth in claim 1 wherein the discharge that communicates the plenum chamber with the upper opening includes a transversely extending portion extending from the upper end of the plenum chamber to an area above the upper opening.

3. An air induction system as set forth in claim 2 further including baffle means interposed between the plenum chamber and the discharge portion.

4. An air induction system as set forth in claim 1 further including a drain port at a lower portion of the plenum chamber for draining water therefrom.

5. An air induction system as set forth in claim 4 wherein the plenum chamber has a generally V-shaped lower portion terminating at the drain port.

6. An air induction system as set forth in claim 5 wherein the discharge that communicates the plenum chamber with the upper opening includes a transversely extending portion extending from the upper end of the plenum chamber to an area above the upper opening.

7. An air induction system as set forth in claim 6 further including baffle means interposed between the plenum chamber and the discharge portion.

8. An air induction system as set forth in claim 1 wherein the induction system air intake comprises a down draft carburetor with the upper opening being formed by the air inlet of the carburetor.

9. An air induction system as set forth in claim 8 wherein the discharge that communicates the plenum chamber with the upper opening includes a transversely extending portion extending from the upper end of the plenum chamber to an area above the upper opening.

10. An air induction system as set forth in claim 9 further including baffle means interposed between the plenum chamber and the discharge portion.

11. An air induction system as set forth in claim 9 further including a drain port at a lower portion of the plenum chamber for draining water therefrom.

12. An air induction system as set forth in claim 11 wherein the plenum chamber has a generally V-shaped lower portion terminating at the drain port.

13. An air induction system as set forth in claim 12 wherein the discharge that communicates the plenum chamber with the upper opening includes a transversely extending portion extending from the upper end of the plenum chamber to an area above the upper opening.

14. An air induction system as set forth in claim 13 further including baffle means interposed between the plenum chamber and the discharge portion.

* * * * *